US010633923B2

(12) United States Patent
Downton et al.

(10) Patent No.: US 10,633,923 B2
(45) Date of Patent: Apr. 28, 2020

(54) SLIDABLE ROD DOWNHOLE STEERING

(71) Applicant: Novatek IP, LLC, Provo, UT (US)

(72) Inventors: Geoff Downton, Stroud (GB); Jonathan D. Marshall, Mapleton, UT (US)

(73) Assignee: NOVATEK IP, LLC, Provo, UT (US)

( * ) Notice: Subject to any disclaimer, the term of this patent is extended or adjusted under 35 U.S.C. 154(b) by 0 days.

(21) Appl. No.: 15/935,316

(22) Filed: Mar. 26, 2018

(65) Prior Publication Data

US 2019/0292854 A1 Sep. 26, 2019

(51) Int. Cl.

| | |
|---|---|
| ***E21B 10/42*** | (2006.01) |
| ***E21B 10/62*** | (2006.01) |
| ***E21B 17/00*** | (2006.01) |
| ***E21B 7/06*** | (2006.01) |
| *E21B 17/10* | (2006.01) |

(52) U.S. Cl.

CPC ..... *E21B 7/064* (2013.01); *E21B 10/42* (2013.01); *E21B 10/62* (2013.01); *E21B 17/006* (2013.01); *E21B 17/1078* (2013.01)

(58) Field of Classification Search

CPC combination set(s) only.
See application file for complete search history.

(56) References Cited

U.S. PATENT DOCUMENTS 2,317,010 A 4/1943 Wingard
2,886,293 A * 5/1959 Carr ..... E21B 7/064 175/339
4,211,292 A 7/1980 Evans
4,262,758 A 4/1981 Evans
5,213,168 A 5/1993 Warren et al.
6,484,819 B1 11/2002 Harrison
7,409,901 B2 8/2008 Lucas et al.
7,810,585 B2 * 10/2010 Downton ..... E21B 7/06 175/73
7,849,936 B2 12/2010 Hutton
8,087,479 B2 1/2012 Kulkarni et al.
8,141,657 B2 3/2012 Hutton
8,590,638 B2 11/2013 Downton
8,689,905 B2 4/2014 Krueger et al.
8,727,036 B2 5/2014 Johnson et al.
8,746,368 B2 * 6/2014 Johnson ..... E21B 17/1092 175/384
8,757,294 B2 6/2014 Johnson et al.
(Continued)

FOREIGN PATENT DOCUMENTS

GB 2408757 6/2005
GB 2422388 7/2006
(Continued)

*Primary Examiner* — Giovanna C Wright
*Assistant Examiner* — Brandon M Duck
(74) *Attorney, Agent, or Firm* — Philip W. Townsend, III

(57) ABSTRACT

A steerable downhole tool may alter a direction of travel of a drilling operation while drilling into the earth. The tool may accomplish this by extending a rod from openings disposed in a side of the tool. The rod may slide within a cavity passing from one of the openings to another. The rod may degrade material from an internal surface of a borehole in which the tool is traveling, by engaging the surface with cutter elements exposed on opposing tips of the rod. The tool may also push off of the borehole wall opposite from the area of degradation.

20 Claims, 6 Drawing Sheets

(56) References Cited

U.S. PATENT DOCUMENTS

| | | | | |
|---|---|---|---|---|
| 8,763,726 | B2 | 7/2014 | Johnson et al. | |
| 9,085,941 | B2 | 7/2015 | Hall et al. | |
| 9,255,450 | B2 | 2/2016 | Jain et al. | |
| 9,279,293 | B2 | 3/2016 | Izbinski | |
| 9,708,859 | B2 | 7/2017 | Jain et al. | |
| 2009/0032306 | A1 | 2/2009 | Addis et al. | |
| 2009/0057018 | A1 | 3/2009 | Farley | |
| 2010/0032207 | A1 | 2/2010 | Potter et al. | |
| 2013/0248252 | A1 | 9/2013 | Oesterberg et al. | |
| 2016/0053551 | A1 | 2/2016 | Jain et al. | |
| 2017/0175455 | A1 | 6/2017 | Jain et al. | |
| 2017/0254150 | A1* | 9/2017 | Stockey ..... | E21B 3/00 |

FOREIGN PATENT DOCUMENTS

| | | | |
|---|---|---|---|
| GB | 2428713 | A | 2/2007 |
| WO | 2006085105 | A1 | 8/2006 |
| WO | 2007012858 | A1 | 2/2007 |

* cited by examiner

SLIDABLE ROD DOWNHOLE STEERING

BACKGROUND

When exploring for or extracting subterranean resources such as oil, gas, or geothermal energy, and in similar endeavors, it is common to form boreholes in the earth. To form such a borehole, an embodiment of which is shown in FIG. 1, a drill bit 112 may be suspended from a derrick 113 by a drill string 114. While a land-based derrick is shown, water-based structures are also common. This drill string 114 may be formed from a plurality of drill pipe sections 115 fastened together end-to-end. In other embodiments a flexible tubing may be used. As the drill bit 112 is rotated, either at the derrick 113 or by a downhole motor, it may engage and degrade a subterranean formation 116 to form a borehole 111 therethrough. Drilling fluid may be passed along the drill string 114, through each of the drill pipe sections 115, and expelled at the drill bit 112 to cool and lubricate the drill bit 112 as well as carry loose debris to a surface of the borehole 111 through an annulus surrounding the drill string 114.

At times it may be desirable to alter a direction of travel of a drill bit while it drills from a path it might naturally take through the earth. This may be to steer the drill bit toward valuable resources or away from obstacles. This may also be to merely keep the drill bit from veering off course. Either way, a variety of techniques have been developed allowing for steering of a drill bit as drilling progresses.

BRIEF DESCRIPTION

A steerable downhole tool may alter a direction of travel of a drill bit while drilling into the earth by extending a rod from openings disposed in a side of the tool. The rod may slide within a cavity, spanning a width of the tool, passing from one of the openings to another and extending from various openings at various times.

The rod may degrade material from an internal surface of a borehole in which the drill bit is traveling, by engaging the surface with cutter elements exposed on opposing tips of the rod. A stabilizer, protruding from the side of the tool, may then push off of the borehole wall opposite from the area of degradation to drive the drill bit into the degraded region.

For example, while the tool is rotating within the borehole, the rod may be extended from a first of the openings. With the rod extended, the tool may be rotated about an axis thereof to degrade a portion of the borehole. After a certain amount of rotation, roughly one-half of a full rotation in some embodiments, the rod may be retracted to a neutral position within the tool. The tool may continue to rotate until a second of the openings is adjacent to the area where the rod was initially extended. At this point, the rod may be extended from the second opening and the tool may be rotated another roughly one-half rotation to continue degradation of the same area.

DRAWINGS

FIGS. 5-1 and 5-2 are orthogonal views of embodiments of slidable rods of various geometries.

FIGS. 6-1 through 6-4 are orthogonal views of embodiments of drill bits in boreholes, each representing one step of a method for steering a downhole tool.

DETAILED DESCRIPTION

Figure 2:
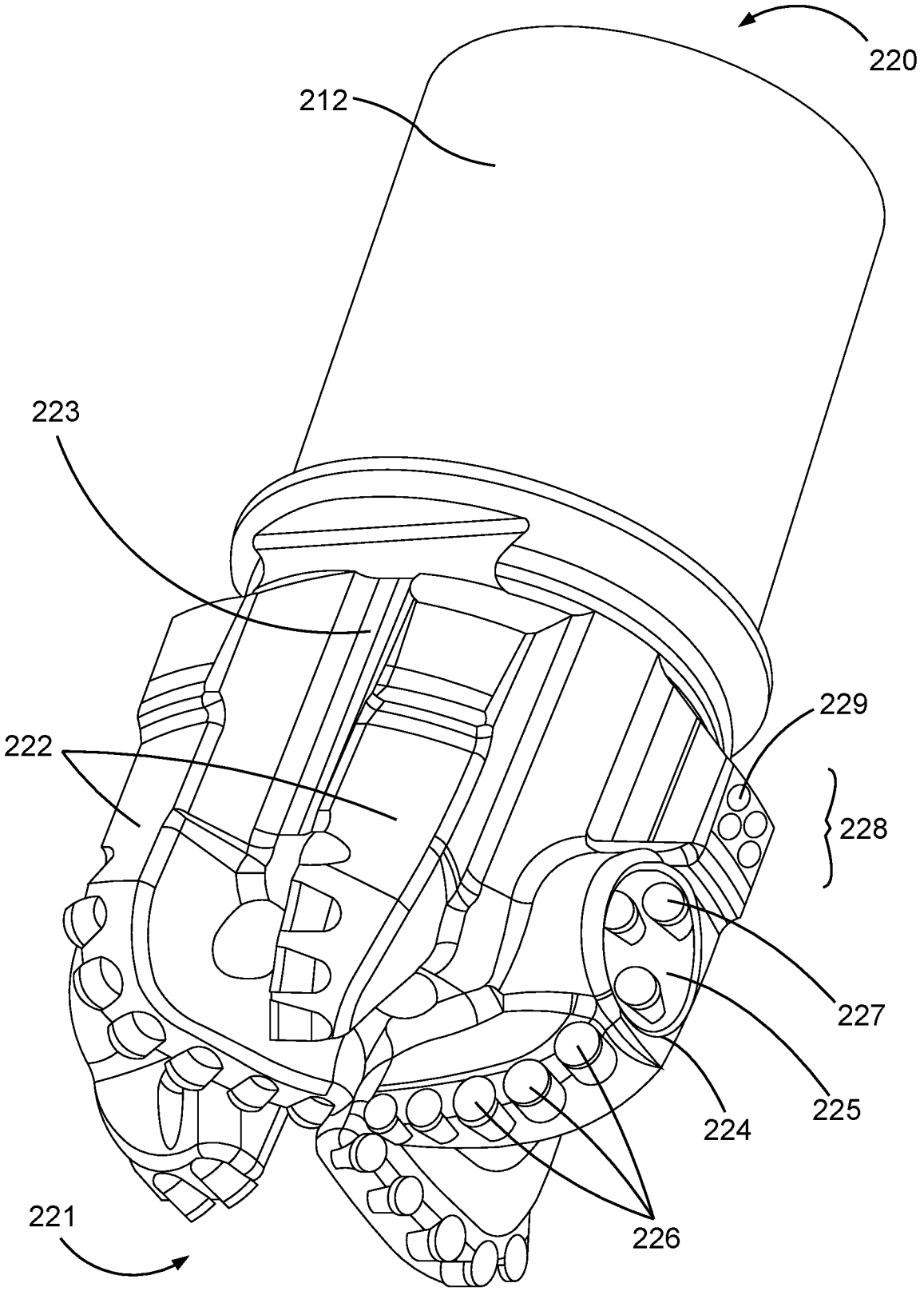
FIGS. 2 and 3 are perspective and longitude-sectional views, respectively, of embodiments of steerable downhole drill bits.

FIG. 2 shows one embodiment of a drill bit 212 capable of degrading the earth, when rotated, to form a borehole therethrough. The drill bit 212 may be joined at an attachment end 220 thereof to a drill string (not shown) running the length of such a borehole. Opposite from the attachment end 220 the drill bit 212 may comprise an engagement end 221 comprising a plurality of blades 222 protruding therefrom. These blades 222 may be generally spaced about a periphery of the engagement end 221 and wrap from the engagement end 221 over to a side 223 of the drill bit 212. A plurality of tough cutter elements 226 may be secured to each of the blades 222 to aid in degrading hard earthen materials.

The side 223 may span from the attachment end 220 to the opposing engagement end 221 and comprise an opening 224 therein. A tip 225, comprising additional cutter elements 227 secured thereto, may be extendable from within the opening 224 to degrade a specific section of an adjacent borehole wall (not shown) surrounding the drill bit 212. A stabilizer 228, axially spaced from the opening 224, may protrude from the side 223. This stabilizer 228 may comprise tough gage elements 229 designed to push against and ride along the borehole wall without wearing away. As the cutter elements 227 of the tip 225 degrade the specific wall section, as described previously, the stabilizer 228 may push off of the borehole wall into the degraded section, as will be described below.

Figure 3:
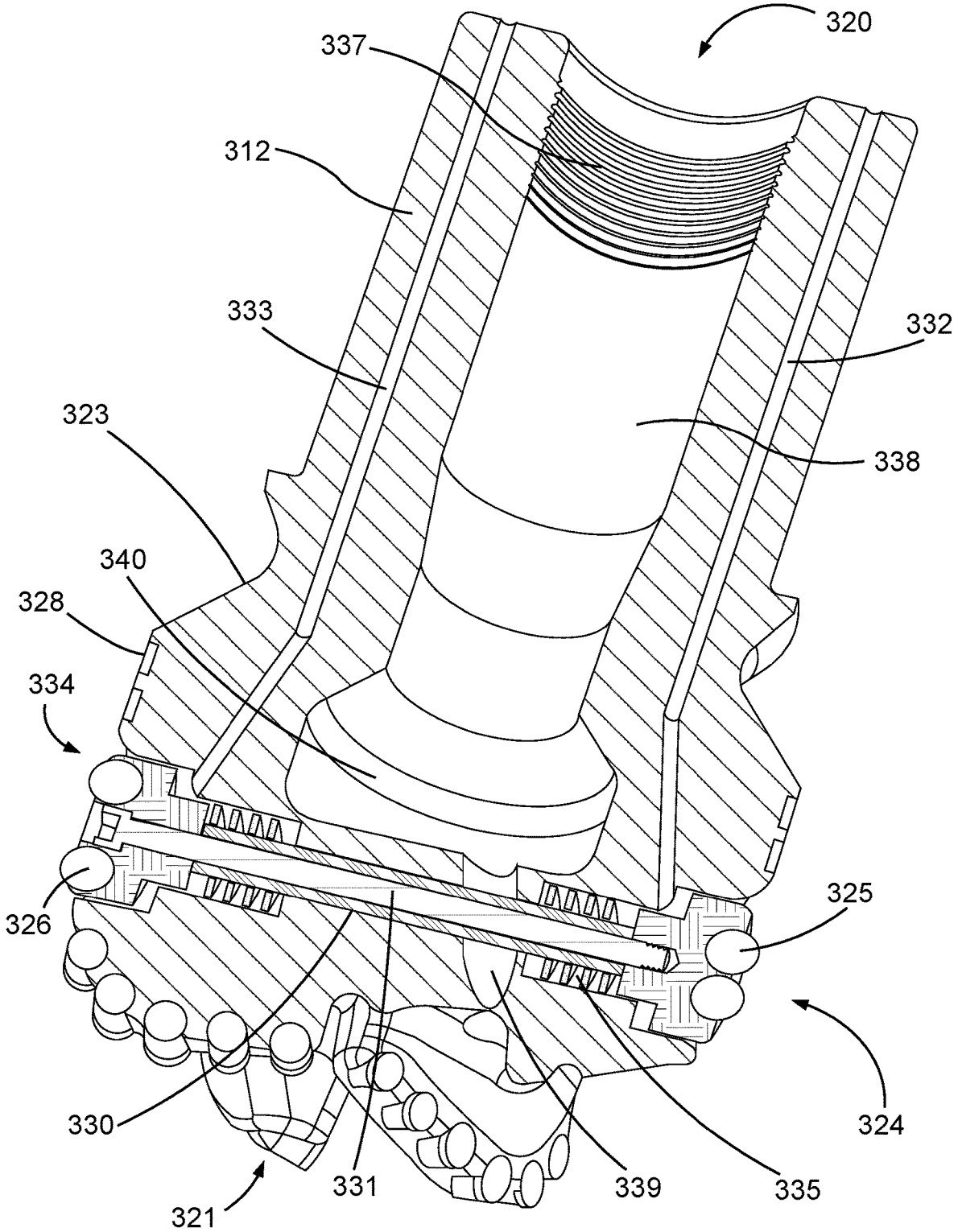

FIG. 3 shows another embodiment of a drill bit 312. The drill bit 312 comprises a plurality of threads 337 disposed within an attachment end 320 thereof, providing a mechanism for attachment to a drill string (not shown). The drill bit 312 also comprises a conduit 338 passing therethrough, allowing for drilling fluid conducted along a drill string to exit from an engagement end 321 of the drill bit 312, through nozzles 339 disposed therein, to aid in drilling.

A first opening 324 on a side 323 of the drill bit 312 may be connected to a second opening 334, opposite the first opening 324, by an elongate cavity 330 passing through the drill bit 312. Cutter elements 325, 326, extendable from the first opening 324 and second opening 334 respectively, may be attached to a common rod 331 slidable within the cavity 330. As the rod 331 slides within the cavity 330 the cutter elements 325, 326 may extend or retract from their respective openings. Because both cutter elements 325, 326 are secured to opposing tips of the same rod 331, as one extends the other may retract. In the embodiment shown, the rod 331 is positioned between the engagement end 321 of the drill bit 312 and a plenum 340 of the conduit 338 wherein the nozzles 339 separate therefrom.

Extension or retraction of the cutter elements 325, 326 may be caused by the introduction of pressurized fluid that may urge the rod 331 to slide within the cavity 330. In the embodiment shown, pressurized fluid within a first channel 332 may urge the rod 331 to extend from the first opening 324. Subsequently, pressurized fluid within a second channel 333 may urge the rod 331 to return to a neutral position within the cavity 330. In some embodiments, such as the one shown, at least one spring 335 may also urge the rod 331 toward the neutral position. Pressurized fluid within the second channel 333 may then urge the rod 331 to extend from the second opening 334.

One motivation for securing the cutter elements 325, 326 to the single rod 331 may be to maintain a generally consistent borehole width while drilling. Further, it is believed that the specific positioning of the cutter elements 325, 326 relative to a remainder of the drill bit 312 may be important to maintaining a consistent borehole width. In the embodiment shown, cutter elements 325, 326 disposed on opposing tips of the rod 331 are positioned farther apart from each other than opposing stabilizers 328 protruding from the side 323 of the drill bit 312. The stabilizers 328 themselves may be positioned farther apart than a width of the engagement end 321 of the drill bit 312 such that the cutter elements 325, 326 are not required to degrade too much material. In such a configuration, the cutter elements 325, 326 may remain exposed at all times, to some degree, to an adjacent borehole wall (not shown) surrounding the drill bit 312.

Figure 4:
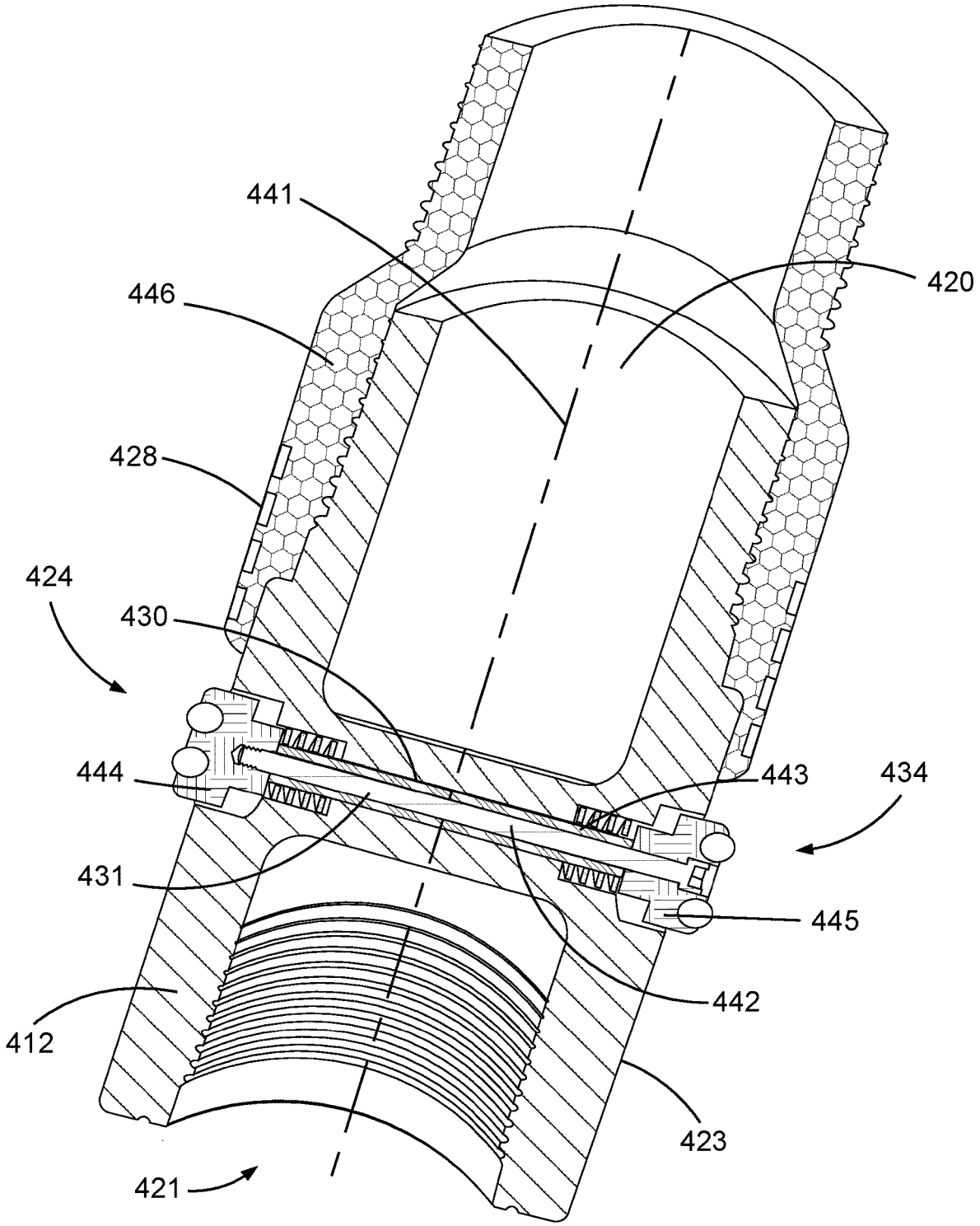
FIG. 4 is a longitude-sectional view of an embodiment of a steerable downhole drill pipe section comprising an interchangeable stabilizer.

FIG. 4 shows an embodiment of another steerable downhole tool, a drill pipe section in this case. The drill pipe section comprises a main body 412 rotatable about an axis 441 and comprising a first end 420 opposite from a second end 421. Both the first and second ends 420, 421 may comprise threads for connection to other elements. A side 423 may span between the first and second ends 420, 421. This side 423 may comprise two openings 424, 434 therein both leading to a cavity 430 passing through the body 412. A rod 431 may be slidably disposed within the cavity 430. Both the rod 431 and cavity 430 may be positioned within a plane perpendicular to the rotational axis 441. In the embodiment shown, the rod 431 actually intersects the rotational axis 441 of the body 412, however this is not necessary.

The rod 431 may comprise a shaft 442 surrounded by a bearing sleeve 443. The rod 431 may also comprise replaceable caps 444, 445 secured on opposing tips of the shaft 442. In the embodiment shown the replaceable caps 444, 445 are held to the shaft 442 via a threaded bolt; however a variety of other connections are also possible. The caps 444, 445 may be replaceable to allow for quick exchange should they become worn out or damaged.

A stabilizer body 446 may be threadably secured to the first end 420 of the main body 412. This stabilizer body 446 may have a stabilizer 428 protruding radially therefrom. When the stabilizer body 446 is threaded to the main body 412 the stabilizer 428 may sit axially spaced from the opening 424 of the main body 412. In this position, the stabilizer 428 may push against a borehole wall (not shown) when the rod 431 is extended from the opposite opening 434. In this thread-on configuration, the stabilizer body 446 may be interchangeable with other similar bodies to allow for quick modification of stabilizer size, or merely replacement when worn or damaged.

Figure 5:
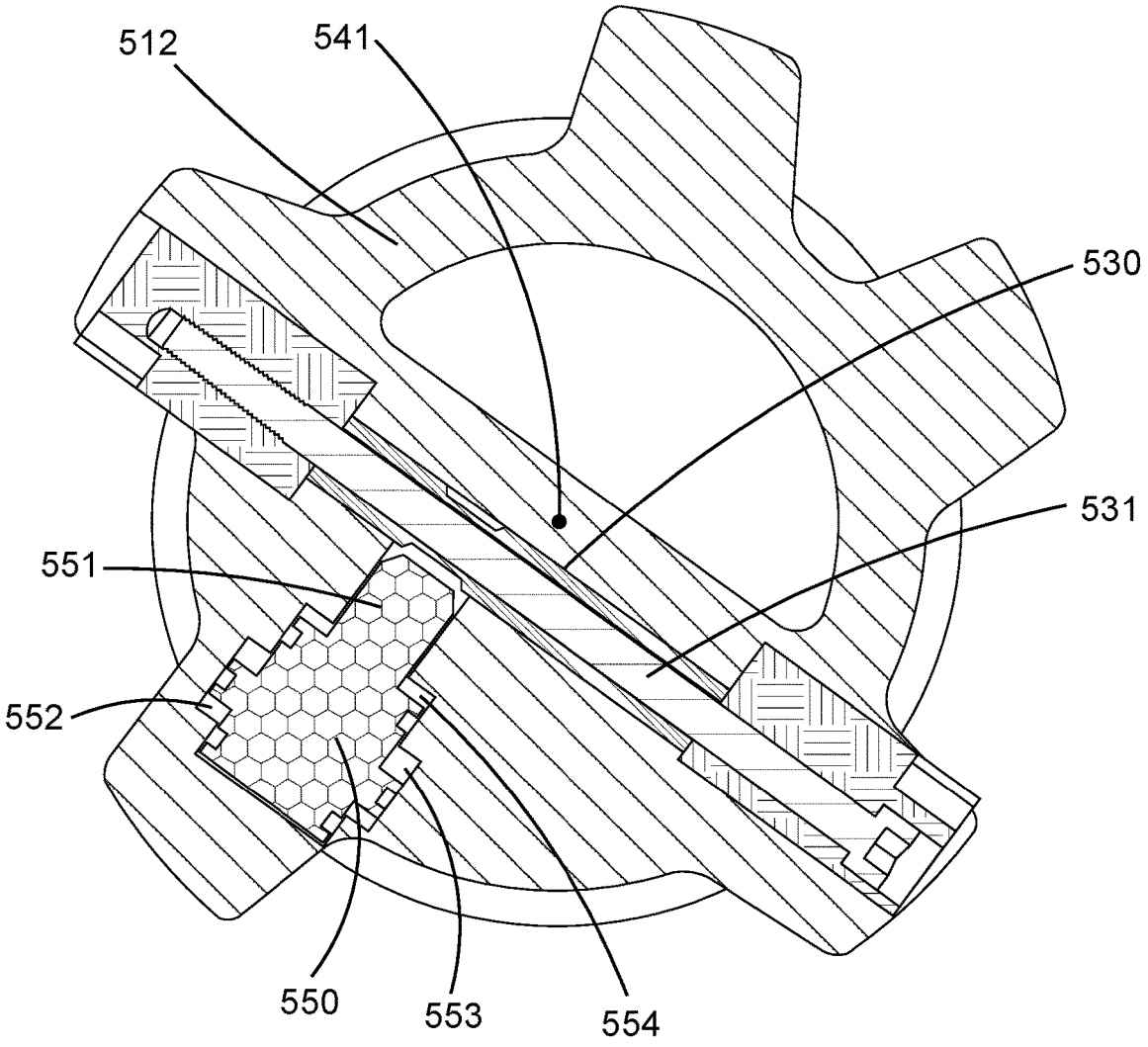
FIG. 5 is a cross-sectional view of an embodiment of a steerable downhole tool comprising a locking mechanism.
Figures 1, 5:
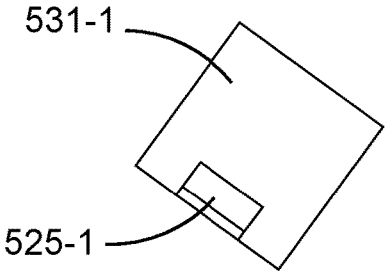
Figures 2, 5:
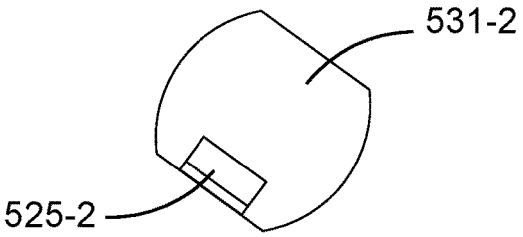

FIG. 5 shows another embodiment of a steerable downhole tool comprising a rod 531 and cavity 530 offset from a rotational axis 541 of a body 512 of the tool. In this embodiment, the tool also comprises a locking mechanism 550 housed within the body 512. While a variety of designs are possible, the locking mechanism 550 shown comprises a latch 551 that may translate relative to the rod 531. When translated toward the rod 531, a convergent point of the latch 551 may engage with a mating geometry of the rod 531 to first urge the rod 531 toward a neutral position within the cavity 530 and then eventually lock the rod 531 in place within the cavity 530. When translated away from the rod 531, the latch 551 may release the rod 531 such that it may again slide freely within the cavity 530. It has been found that forming the latch 551 and rod 531 of different materials, each comprising unique properties, may reduce galling during locking allowing for ease of release.

Translation of the latch 551 may be achieved by adjusting fluid pressures in various chambers surrounding the latch 551. These chambers may be filled by the same pressurized fluid used to urge the rod 531 to extend or retract. For example, in the embodiment shown, a first chamber 552 may be pressurized at a generally constant pressure. When no other forces are acting, this generally constant pressure may urge the latch 551 against the rod 531 to lock it in place. When either of a second chamber 553 or third chamber 554 are filled with pressurized fluid however, the generally constant pressure within the first chamber 552 may be overcome to urge the latch 551 away from the rod 531 and release it from lock. Pressurized fluid being channeled to urge the rod 531 to slide axially in one direction may also feed into the second chamber 553 while pressurized fluid being channeled to urge the rod 531 to slide axially in an opposite direction may feed into the third chamber 554. Thus, in such a configuration, the rod 531 may be axially locked until fluid is sent to urge it in either direction, and then it may be unlocked and free to slide.

Figure 1:
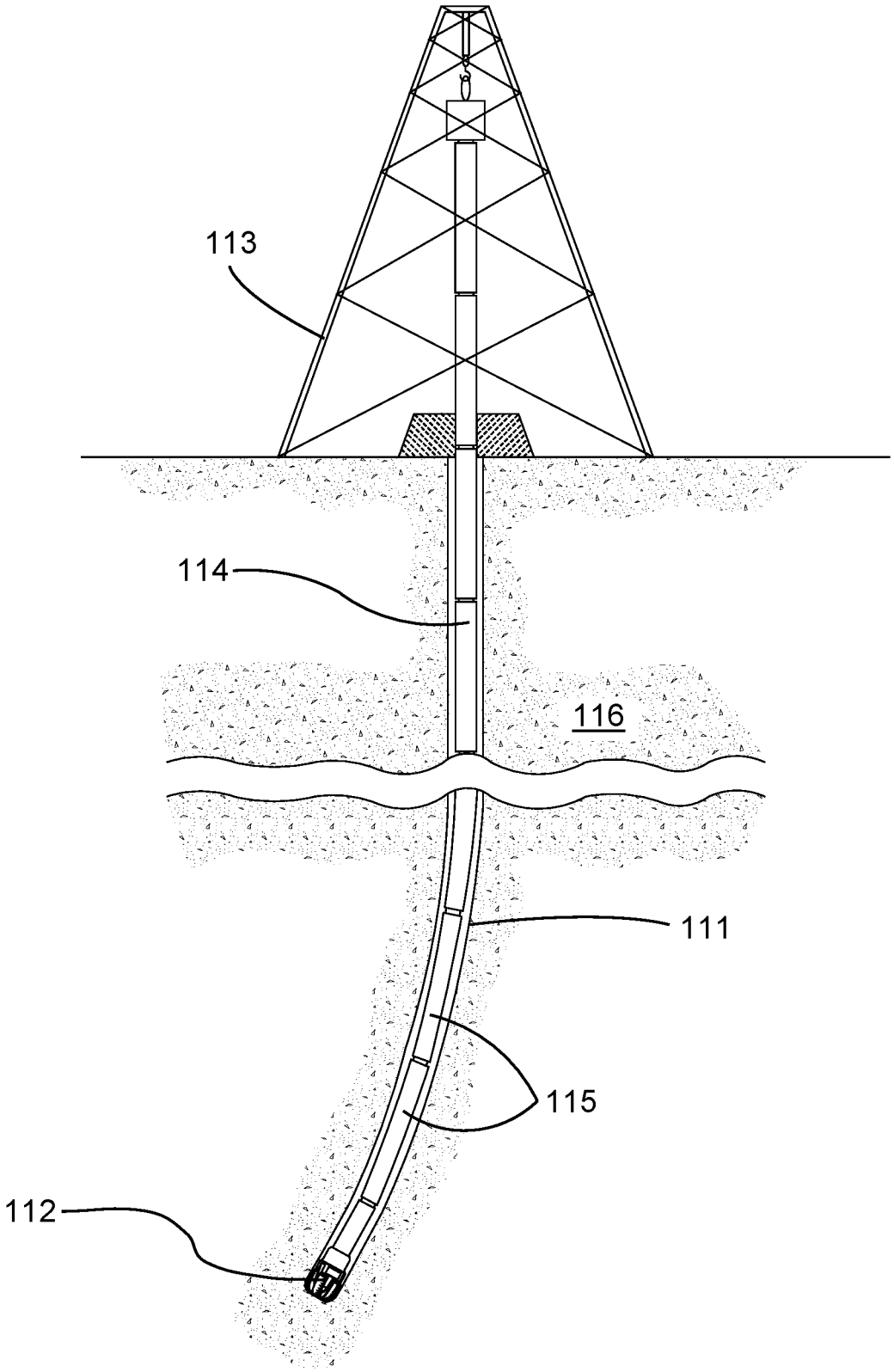
FIG. 1 is an orthogonal view of an embodiment of a drilling operation comprising a downhole drill bit secured to an end of a drill string suspended from a land-based derrick.

FIGS. 5-1 and 5-2 show embodiments of rods 531-1, 531-2 comprising various cross-sectional geometries. The cross-sectional geometries of the rods 531-1, 531-2 may be non-cylindrical and may mate with matching cavities to restrain rotation of the rods 531-1, 531-2 relative to their respective cavities. This restraint may keep cutter elements 525-1, 525-2, attached to each of the rods 531-1, 531-2, aligned as their respective tools rotate.

Figures 1, 6:
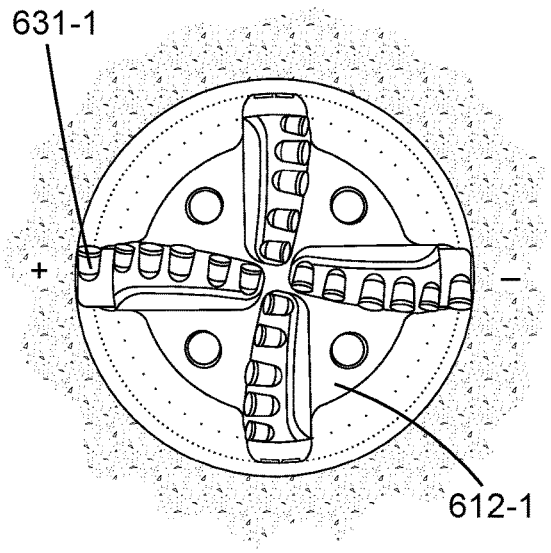
Figures 2, 6:
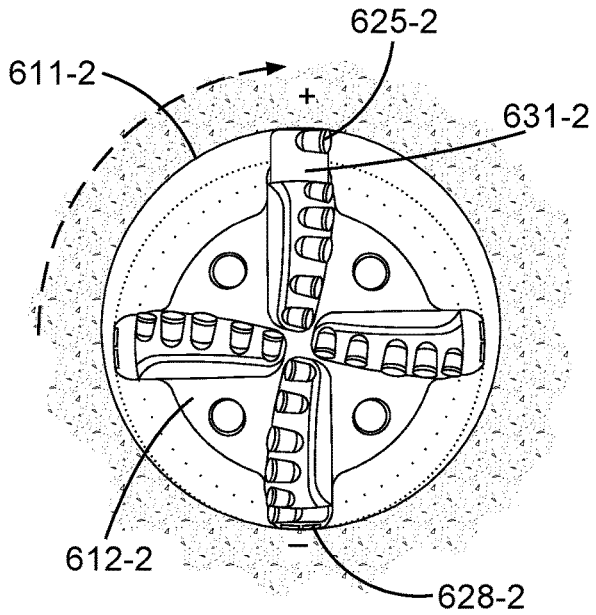
Figures 3, 6:
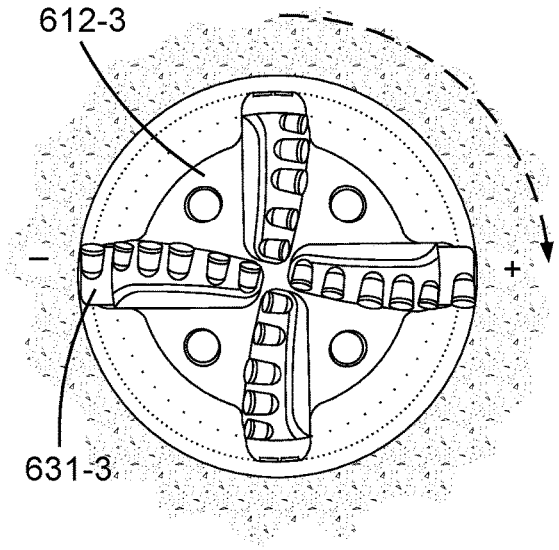
Figures 4, 6:
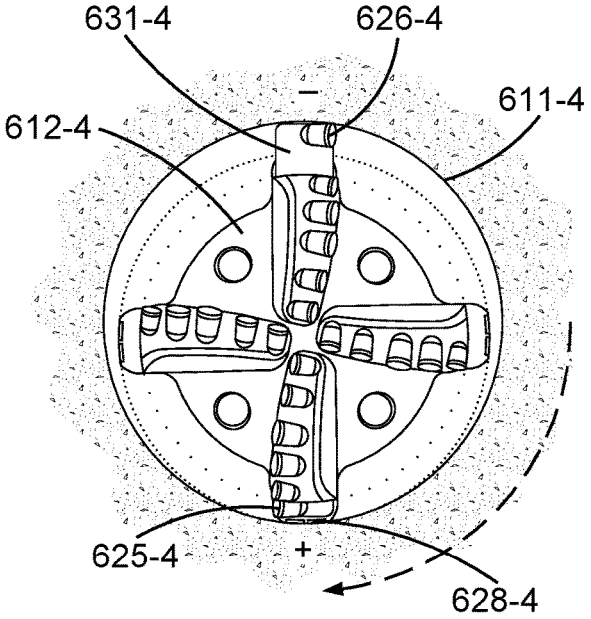

FIGS. 6-1 through 6-4 show different steps to downhole steering made possible by aspects of the embodiments described previously. Specifically, FIG. 6-1 shows an initial position of a steering tool 612-1 comprising a slidable rod 631-1 housed therein. In this figure, the rod 631-1 is positioned in a neutral position within the tool 612-1. As a tool 612-2 rotates, as shown in FIG. 6-2, about a central axis thereof, a rod 631-2 may be slid in one direction along its length such that it extends from one side of the tool 612-2. Extension of this rod 631-2 may cause a first cutter element 625-2 attached to the rod 631-2 to engage and degrade a borehole wall 611-2 surrounding the tool 612-2. This extension may also push a stabilizer 628-2, positioned opposite from the first cutter element 625-2, against the borehole wall 611-2, thus pushing the entire tool 612-2 in the direction of the degradation.

After rotating about its axis generally 180 degrees (other amounts are also anticipated), as shown in FIG. 6-3, a rod 631-3 may retract to the neutral position within its respective tool tool 612-3. From this position, a second cutter element 626-4, as shown in FIG. 6-4, attached to a rod 631-4, opposite from a first cutter element 625-4, may be extended from a side of a tool 612-4 to degrade a borehole wall 611-4 while the tool 612-4 rotates another generally 180 degrees in a similar manner as shown previously; with a different stabilizer 628-4 pushing toward the area of degradation. From here, the method may repeat from the beginning.

Whereas the preceding has been described in particular relation to the figures attached hereto, it should be understood that other and further modifications apart from those shown or suggested herein, may be made within the scope and spirit of the present invention.

The invention claimed is:

1. A steerable downhole tool, comprising:

a body comprising two opposing ends and a side spanning the ends;

two openings in the side and an elongate cavity, passing through the body, connecting the two openings; and a rod, axially-slidable along a length of the rod, disposed within the cavity and alternatingly extendable from both openings; wherein the rod comprises at least one cutter element disposed at each of two opposing tips thereof.

2. The steerable downhole tool of claim 1, wherein the body comprises a rotational axis passing through both ends thereof, and the rod is positioned within a plane perpendicular to the rotational axis, at right angles in relation thereto.

3. The steerable downhole tool of claim 1, wherein the body comprises a rotational axis passing through both ends thereof, and the rod intersects the rotational axis.

4. The steerable downhole tool of claim 1, wherein the body comprises a conduit passing therethrough leading to a plenum, and the rod is positioned between the plenum and one of the two opposing ends.

5. The steerable downhole tool of claim 1, further comprising at least one channel conducting pressurized fluid to urge the rod to extend from one of the openings.

6. The steerable downhole tool of claim 5, further comprising at least one second channel conducting pressurized fluid to urge the rod toward a neutral position within the cavity.

7. The steerable downhole tool of claim 1, further comprising at least one spring urging the rod toward a neutral position within the cavity.

8. The steerable downhole tool of claim 1, further comprising a lock selectively retaining the rod in a neutral position within the cavity.

9. The steerable downhole tool of claim 8, wherein the lock urges the rod toward the neutral position before retaining it.

10. The steerable downhole tool of claim 8, wherein the rod is locked when no pressurized fluid is acting on the rod and unlocked when pressurized fluid is urging the rod in either axial direction.

11. The steerable downhole tool of claim 1, wherein the rod comprises a cross sectional geometry restraining rotation of the rod within the cavity.

12. The steerable downhole tool of claim 1, wherein the rod comprises a replaceable cap disposed at each of two opposing tips thereof.

13. The steerable downhole tool of claim 1, wherein the rod comprises a shaft surrounded by a bearing sleeve.

14. The steerable downhole tool of claim 1, wherein the body comprises an engagement end on one of the two opposing ends and a stabilizer protruding from the side, and a width of the stabilizer is greater than a width of the engagement end.

15. The steerable downhole tool of claim 1, wherein the body comprises an engagement end on one of the two opposing ends and a stabilizer protruding from the side, and a length of the rod is greater than a width of the stabilizer and a width of the engagement end.

16. The steerable downhole tool of claim 1, further comprising a second body secured to one of the two opposing ends, wherein the second body comprises a stabilizer protruding radially therefrom.

17. The steerable downhole tool of claim 1, wherein the opposing tips' cutter elements remain constantly exposed.

18. A method for downhole steering, comprising:

providing a body comprising two opposing ends and a side spanning the ends;

extending a rod axially along a length of the rod from a first opening in the side of the body and degrading a formation surrounding the body with at least one cutter element disposed on a tip of the rod;

rotating the body about an axis passing through both ends;

extending the rod axially along the length of the rod from a second opening in the side opposite from the first opening, while retracting the rod from the first opening, and degrading the formation with at least one cutter element disposed on an opposite tip of the rod; and further rotating the body about the axis.

19. The method for downhole steering of claim 18, wherein rotating the body comprises rotating the body 180 degrees and further rotating the body comprises further rotating the body 180 degrees.

20. The method for downhole steering of claim 18, further comprising pushing off of the formation with a stabilizer protruding from the body opposite from the degradation.

* * * * *